United States Patent [19]

Isawa et al.

[11] 4,039,697

[45] Aug. 2, 1977

[54] PROCESS FOR FORMING A FILM COMPOSED OF PLASTIC-COATED INORGANIC POWDER PARTICLES

[75] Inventors: Kazuo Isawa; Masatsugu Maejima, both of Tokyo; Hideo Nagasaka, Hitachi, all of Japan

[73] Assignee: The Fujikura Cable Works, Ltd., Tokyo, Japan

[21] Appl. No.: 499,157

[22] Filed: Aug. 21, 1974

[30] Foreign Application Priority Data

Aug. 27, 1973 Japan ..... 48-95924

[51] Int. Cl.[2] ..... C25D 13/20; B05D 1/06

[52] U.S. Cl. ..... 427/27; 204/181; 427/28

[58] Field of Search ..... 204/181; 427/21, 27

[56] References Cited

U.S. PATENT DOCUMENTS

| | | | |
|---|---|---|---|
| 3,093,511 | 6/1963 | Weisel et al. | 204/181 |
| 3,464,906 | 9/1969 | Ridley et al. | 204/181 |
| 3,575,900 | 4/1971 | Ponyik | 204/181 |
| 3,616,388 | 10/1971 | Meier et al. | 204/181 |
| 3,844,919 | 10/1974 | Shiota et al. | 204/181 |
| 3,928,668 | 12/1975 | Snow | 427/27 |

*Primary Examiner*—Howard S. Williams

*Attorney, Agent, or Firm*—Toren, McGeady and Stanger

[57] ABSTRACT

A uniform, thick film is formed by applying a powdered metal, alloy, sulfide of metal or glass each particle of which is coated with plastics 1–15% by weight, preferably the particle surfaces having been treated with an aliphatic acid or a silane-type surface-treating agent and the plastics including an organic peroxide, to a substrate by electrostatic powder spraying, fluidized bed coating, electrophoretic deposition, or by electrostatic fluidization, and fixing the layer thus provided on the substrate with heating to such extent that the plastic ingredient is fused or volatilized, to finally produce the desired film. The materials having such films fixed thereon have a wide application for interior building and glass-lining and as material of bearings.

11 Claims, No Drawings

PROCESS FOR FORMING A FILM COMPOSED OF PLASTIC-COATED INORGANIC POWDER PARTICLES

FIELD OF THE INVENTION

This invention relates to a process of forming a film on a substrate by applying thereto a powdered substance composed of plastic-coated inorganic particles by electrostatic powder spraying (hereinafter referred to as EPS), fluidized bed coating, electrophoretic deposition, or electrostatic fluidization and then fixing the thusapplied coating by fusion or sintering. In particular, the invention is characterized by addition of an organic peroxide to the plastics material thereby to prevent the thick film usually obtained by EPS from leaving any decomposed residues unsintered.

DESCRIPTION OF THE PRIOR ART

Of late years, the application of powdered coatings, in which no solvent in used, has increasingly been practised since as a result thereof, the dangers of fire and air-polluting hazards can be avoided and the capability of forming good films, sufficiently thick and free of pinholes is obtained. According to a conventional method of coating steel surfaces with metal powder composed of certain dielectric-coated particles by EPS, there have been achieved only a comparatively thin film or film coating of, say, one hundred and several tens of microns at the most.

Speaking of a known film-forming method to obtain heat and corrosion resisting films by applying a finely powdered glass to a substrate using a spray gun and then fixing by sintering, or the so-called glass lining method, it is capable of producing films having a thickness of about 1 mm. This method, however, has the disadvantage that the glass powder which has been applied and adhered to the surface through an inorganic binder mixed therewith tends to reduce its bonding strength on natural drying and to peel off or form a film having an irregular surface and an non-uniform thickness, unless it is subjected to sintering immediately after the application. Accordingly, the known method can not be adapted for a mass production of such coated articles since the unfinished products, or products waiting for the sintering process, are unsuitable for long storage in situ, or during transportation. Incidentally, it has been found impossible to apply this method with a metal powder in lieu of the glass powder.

Another sintered-film forming method hithertofore proposed comprises applying a metal or alloy powder composed of particles coated with a certain plastic material to steel surfaces in certain relative amounts by EPS and thereupon fusing or volatilize the plastic ingredient with heat to form a sintered layer fixed to the surfaces. According to this method, however, the uniformity of the coated surfaces can hardly be achieved, nor a sufficient thickness to the resulting layer. Further, the same method is disadvantaged by the fact that the plastic materials suitable for coating particles of the metal or alloy powder are limited and their use has to be limited to a reduced amount and the powder particles useful for the purpose are limited size-wise to a narrow range. These disadvantages of the method result from the powder particles being unsuitable for EPS.

Therefore, it may be concluded that the abovedescribed conventional method present difficulties in obtaining the uniformity of coating film, in particular, due to their disregarding the question of the compatibility of the plastic coating with the surface of any particulate material.

Particularly for purposes of applying EPS, it is preferred that the particulate plasticcoated material, which is to be bonded to substrate surfaces by Coulomb's force, should possess as great an electric chargeability as possible. This purpose may be attained to some extent by applying more plastic coating to produce a thicker coat, but this is not recommended. Since the plastic ingredient may, subsequently, be removed by volatilization. Further, when the particular material is a material having a great specific gravity, like metal, the total weight of the finished plastic-coated product will naturally be so great as to be unsuitable for use in EPS, and should necessarily be decreased as much as possible by, for instance, producing the thinest film on the same particle surfaces. It is another reason for the production of thin films, or reduction in the use of a plastic material that the amount of the plastic material used must be such that the plastic coating composition may completely and successfully sintered, without leaving any of its decomposed residues unsintered.

In summation, the plastic coating must make a thin film and not excessive quantity-wise, and still uniformly cover the whole surfaces of the particles. Apart from this, as described already above, a thick film coating, having its own merits for the application of EPS might have been usefully applied only if such thick film formation would be assured to be free of any defective effects during subsequent treatments. Such assurance has been achieved by the method according to the present invention wherein an organic peroxide is added to the plastic coating.

OBJECTS OF THE INVENTION

It is an object of this invention to provide processes of coating various substrates with a powdered substance composed of plastic-coated inorganic particles by any one of EPS, fluidized bed coating, electrophoretic, deposition, and electrostatic fluidization, free of one or more of the above mentioned difficulties or defects encountered in conventional coating methods.

It is another object of the invention to provide processes capable of forming coating films having a thickness that is uniform and greater than that resulting from the conventional methods or as great as possible, but while free of any decomposed residues left unsintered.

SUMMARY OF THE INVENTION

Thus, according to the invention there is provided a process of forming on a substrate a film having no copper-heads or pinholes by coating each particle of inorganic powdered substance with plastics in an amount equal to 1 to 15% by weight of the same particle, applying the plastic-coated powdered substance thus prepared to the substrate and thereupon fixing the coating by heating at a temperature at least above the softening point in the case when the plastic used is amorphous or at least above the melting point in the case when it is crystalline and below the volatilizing point of the plastics.

The inorganic powdered substances useful in the invention include powders of metal, such as, copper, aluminum, tin, lead, titanium, and nickel, their alloys, such as, brass, bronze, and solder, sulfides of metals, with as, molybdenum disulfide and tungsten disulfide, graphite fluoride, glass, such as, silicate glass, soda-lime glass, potassium-lime glass, lead glass, and boratesilicate glass, frit, and ceramics.

The particle size in each inorganic powdered substance is preferred to be in the range of from about 0.1 to about 500μ in diameter. If it is smaller than about 0.1μ, difficulties would arise in achieving a uniform plastic coat while, on the other hand, if it is larger than about 500μ, the resulting coating would be unsuitable for application by EPS.

Particularly speaking of glass powder, the size of the individual particles are most commonly made to vary over the range of from 70 to 1,000 mesh by the Tyler Standard screen scale, the range being suitable for glass particles to be coated with plastic material in a satisfactory condition to make a coat of uniform thickness. If the glass particle size is smaller than 1,000 mesh size, no uniform coat would be available while, on the other hand, if it is larger than 70 mesh size, difficulties would arise in achieving a film having a uniform thickness on any substrates, using the various coating methods.

In carrying out the process in part of this invention wherein the inorganic powdered substance of the varieties and the particle sizes as described above has its particles coated with plastic material in an amount equal to 1 to 15% by weight of the powdered substance, it is most desirable to render the particle surfaces compatible with the plastic coating by a certain preliminary surface treatment so that the resulting coating of a uniform thickness may be obtained. Such preliminary surface treatment may be performed by applying to the particle surfaces a straight-chained, saturated aliphatic acid, such as, stearic acid or palmitic acid, or a silane-type surface-treating agent, such as, gammamethacryloxypropyltrimethoxy silane, gamma-glycidoxypropyltrimethoxy silane or beta-ethyltrimethoxy silane, in an amount not exceeding 0.1% by weight of the particle. The application can be carried out by conventional methods. When the surface treating agent has been used in an amount exceeding such 0.1% a uniform plastic coating film cannot be obtained and, besides, the application of EPS and electrophoretic deposition and subsequent treatments will be adversely influenced. Incidentally, the fluidized bed coating may be applied without the above-described surface treatment for the purpose of the present invention.

One of the conventional method for coating powder particles with plastics is called the air suspension method in which plastics dissolved in a solution contacted with solid powder particles in a gaseous phase and the other is called the phase separation in water in which plastics and powder particles are contacted with each other in liquid phase, the latter method being more suitable for achieving uniformly thick coats. Improvements have been proposed by the inventors of this invention to carry out the phase separation in water in a plastics and powder containing emulsifying liquid medium produced by adding an aqueous solution of a hydrophilic protective colloid to a solution of the plastics in which the powder particles have been float-dispersed.

The most suitable amount of the plastics to be used for coating the inorganic powder particles according to the invention is from 1 to 15% by weight based on the weight of the inorganic powder, so that the thus-coated powder product will be adapted for application to fluidized bed coating, EPS, electrophoretic deposition, or electrostatic fluidization.

The above-mentioned amount of the plastics is an amount needed for the formation of a coating film having a satisfactory thickness according to the invention, i.e., greater than 200μ in case the fluidized bed coating is applied, and also for the elimination of any residues at the subsequent sintering stage. If the plastics is used in a less amount, the film formation by the fluidized bed coating method under varied fluid layer conditions tends to achieve films not exceeding about 50μ in thickness, and yet porous to have particle bodies left uncoated and exposed. On the other hand, if amounts exceeding the range set forth above are used, the film formed on a substrate after the sintering treatment tends to contain passages through which gases escaped during the decomposition of the plastics, resulting in insufficient bond between the substrate and the particle bodies near the gas passages. Also, even when the plastic material to which an organic peroxide has been added is used in order to achieve a thicker film through application by EPS, the formation of decomposed residues may be prevented by observing the upper limit set forth above.

Further, referring to a case wherein EPS is applied, amounts of the plastics less than the above-mentioned essential range may result to give an insufficient electric charge to the coating particles and accordingly a poor bonding effect of the particle bodies to the substrate, while amounts larger than the range naturally make the coated particles too heavy weight to achieve long durable bonding effects.

It is a preferable condition for the formation of films having a uniform thickness of not less than 200μ by the fluidized bed coating to apply air under a pressure ranging from 5 to 7 kg/cm$^2$.

Other optimum conditions as to the temperature at which the substrate should be pre-heated, duration of immersion in the fluidized bed coating and the voltage of the current and duration of spraying in EPS should be determined according to the type of plastic coating used as well as the powder particles and the substrate.

The use of an organic peroxide in the formulation of the plastic coating according to the invention is usually in an amount of from 3 to 10 parts by weight based on 100 parts by weight of the plastics. Such organic peroxides may be selected from tert-butylhydroperoxide, methylethylketone peroxide, di-tert-butylperoxide, diphenylperoxide, cumene hydroperoxide, etc. which have a comparatively high critical temperature for decomposition.

The plastic-coated inorganic particles to be used in the process according to the present invention are almost all composed of units of individual particles covered or capsulated with plastics, each enclosing a single piece of nucleus, and such particulate products are suitable for application to the electrophoretic deposition and electrostatic fluidization as well as the fluidized bed coating and EPS.

Illustrative of the plastics useful as the coating of solid powder particles are polyvinyl alcohol resin, epoxy resin, polystyrene resin, polymethylmethacrylate resin, methylcellulose, ethylcellulose, polyvinyl chloride resin, polyethylene resin, polyester resin, and polyurethane resin.

The plastic-coated powder particles may be applied for coating various surfaces of steel, asbestos, bakelite, and the like by a suitable coating method as described above. The coating thus applied to the substrate may be heated to at least the softening point or at least the melting point according to the kind of the plastics used.

to produce a uniform film composed of the fused plastics and the original inorganic particulate material, and further heated up to the volatilizing point of the plastics, to finally form a sintered film. That is to say, the film forming process of the present invention are carried out at temperatures between the softening or melting point and the volatilizing point of the plastics used.

According to the process of the invention, wherein the specific surface treatment should be applied to the original particles and the specific limitation is given to the use of the plastics coating having an organic peroxide added thereto, thick and uniform coating films by any of the above-mentioned conventional coating methods can be obtained.

The process of the invention, compared to the conventional glass lining method in which the coating is a mere mixture of glass powder and a binder and no uniform coating films is provided on the irregular surfaces of the particles, is capable of producing good films of 200μ in thickness or more which are substantially free of the occurrence of the copper-head phenomenon or pinholes.

Further to rating the process of the invention from the commercially operational point of view, coating films on the substrate may be kept, as is, for a long period of time before the subsequent heating treatment is conducted. In case EPS is applied, it is possible to produce and store coating films at once in which the plastics ingredient has been semi-fused and later on to subject the films to sintering, or to transport such unifinished product far away.

The films formed in accordance with the invention can be useful for application to glass lining and material for bearings as well as building material and material for indoor use particularly in case the films are applied to asbestos sheets.

The following examples will further illustrate the invention. In the examples, parts and percentages are all by weight and the designation of screen mesh is based on the Tyler Standard screen scale.

EXAMPLE 1

9.3 kg of copper powder passing through a 400-mesh screen were immersed to an 0.15% solution of stearic acid in ethanol for 10 seconds and thereafter taken out for drying. The stearic acid was retained on the copper particle in an amount equal to 0.08% based on the weight of the particle. The copper powder thus treated was put into a warmed solution of 1 kg polyethylene in 5-liter trichlene. The mixture was stirred. To this solution, while being kept at 70° C, was added a solution of 1 kg polyvinyl alcohol in 30-liter water kept at about 65° C, followed by vigorous agitation. The resulting solution was subjected to repeated decantation and thereafter had the trichlene content evaporated, followed by cooling, washing with water and then drying at 60° C, to produce polyethylene-coated copper particles. The polyethylene coating was 5% in amount and found optically to have a uniform covering of each copper particle.

The polyethylene-coated copper powder particles were sprayed over a steel plate (200 × 200 × 1 mm, SPCE-1) by an electrostatic spray machine (product of Sames) over a period of 15 seconds, the voltage being −80 KV, and the resulting film was about 1 mm thick. Then, the film was subject to a hot press at 150° C under 200 kg/cm$^2$ for 10 seconds and thereupon to sintering in a nitrogen streaming over at 1000±10° C for 90 minutes, to obtain a layer composed of sintered copper about 500μ thick. This has been unavailable by conventional electrostatic coating.)

According to observation of the thus-obtained sintered layer, no polyethylene residues were left therein; no passages of escaping gases were witnessed; 3% of the total copper ingredient was fused and solidified in the surface of the steel plate, to form a layer of copper-steel alloy; some twins were witnessed on the sintered copper surface which was partly deformed by heat. When the sintered layer surface was treated with skin pass or polished, it became very glossy and beautiful.

EXAMPLE 2

8 kg of molybdenum disulfide powder passing through an 800-mesh screen were immersed in an 0.15% solution of stearic acid in ethanol for 10 seconds and thereafter taken out for drying. The stearic acid retained on the molybdenum disulfide particles was 0.08%. The molybdenum disulfide powder thus treated was put into a warmed solution of 1.2 kg polyethylene in 4 liter trichlene. The mixture was stirred and kept at 70° C. To this mixture solution was added a solution of 1.5 kg polyvinyl alcohol in 25 liter water kept at about 65° C, followed by vigorous agitation. The resulting solution was subjected to repeated decantation and thereafter the trichlene was evaporated, followed by, in turn, cooling, washing with water, and drying at 60° C, to produce polyethylene-coated molybdenum disulfide powder particles. The polyethylene coating was 12% in amount and the covering was uniform. The individual particles were separate and apart from each other, and not together in lumps.

The polyethylene-coated molybdenum disulfide powder particles were sprayed over a bronze plate (200 × 200 × 2 mm) by an electrostatic spray machine (product of Sames) over a period of 15 seconds under the voltage of −75 KV. The resulting coating film was about 800μ thick. Then, the film was subjected to heating at 180° C for 5 minutes, to fuse the polyethylene ingredient onto the bronze plate. The fused layer was 600μ thick.

Abrasion tests were then conducted on the above product in comparison wih a bare or uncoated bronze plate and a molybdenum disulfide-coated bronze plate. In the tests, the Taber abraser was employed under the load of 1,000 g with H-18 abrasive and the number of revolution was 300. The test price was sized 100 × 100 mm. The test results showed losses in quantity of 35 mg, 60 mg and 50 mg on the respective test pieces prepared by the procedure of this example, having no coating applied and by applying molybdenum disulfide according to the electrostatic coating. As such, the product of the invention can be highly useful for application to bearings and other materials that need minimized abrasion.

EXAMPLE 3

10 kg of copper oxide powder passing through a 400-mesh screen were immersed in an 0.15% solution of stearic acid in ethanol for 10 seconds and thereafter taken out for drying. The stearic acid retained on the copper oxide power particles was 0.05%. The copper oxide poweder thus treated was put into a solution of 1-kg polystyrene in 5-liter methylene chloride kept at about 30° C and stirred. To this solution was added a solution of 1-kg polyvinyl alcohol in 30-liter water kept at 30° C and the resulting mixture was subjected to agitation at temperatures of 30°–35° C, till the methylene chloride was evaporated. Thereupon, agitation was discontinued, and the mixture solution was decantated 6 times and then washed with ethyl alcohol, followed by drying at 60° C, to produce polyethylene-coated copper oxide powder particles. The particles were sized to pass through a 270-mesh screen, and the polyethylene coating thereon was 6% in amount and uniform in covering.

The powder product was sprayed over a fat- and rust-removal-treated deep drawing steel plate (200 × 200 × 1 mm) by an electrostatic spray machine (product of Sames) over a period of 15 seconds under the voltage of −80 KV. The resulting coating film was about 800μ thick. Then, the film was subjected to hot press under 150 kg/cm² at 130° C for 10 seconds, to increase its density, and thereupon to sintering in a nitrogrn streaming oven at 1,000±10° C for 120 minutes, to finally produce a metallic layer composed of sintered copper, having a thickness of 350μ.

According to observation of the thus-obtained sintered layer, the copper oxide was almost completely reduced by grass produced by the thermal decomposition of the polystrene; there was witnessed a copper-steel alloy layer 0.2μ thick on the interface between the steel plate surface and the sintered layer.

EXAMPLE 4

5 kg of copper powder passing through a 400-mesh screen were immersed in a solution of 100-g peroxysilane (X12-520 of Shinetsu Chemical Company) in methanol, resulting to coat the copper particles with about 0.08% of silane. The silane-coated copper particles were put into a solution of 500-g polystyrene in 3-liter methylene chloride, and the resulting solution was agitated to produce a float-dispersion. To this solution was added a solution of 500-g polyvinyl alcohol in 15-liter water, followed by vigorous agitation to gradually make an emulsifying medium, the agitation being continued till the methylene chloride was evaporated. The resulting liquid was well washed with ethanol and dried at 60° C, to finally produce polystyrene-coated copper powder particles, having a particle size passable through a 300-mesh screen. The polystyrene coating retained on the copper particles was about 6% is amount.

The powder product was sprayed over a steel plate (SPCE-1) by an electrostatic spray machine (product of Sames) over 15 seconds under the voltage of −80 KV, to achieve a coat about 700μ thick. Then, the coating film was subjected to hot press under 180 kg/cm² at 130° C for 10 seconds, to increase its density, and thereupon to sintering in a nitrogen streaming oven at 1,000±10° C for 90 minutes, to finally produce a uniform sintered layer 500μ thick covering the steel plate.

EXAMPLE 5

1 kg of graphite fluoride powder (CF of Japan Carbon Company) passing through an 800-mesh screen was immersed in an 0.15% solution of stearic acid in ethanol, resulting to coat the powder particles with stearic acid about 0.08% in amount. The resulting powder was put into a solution of 100-g epoxy resin in 500-ml methylethylketone, followed by agitation to make a dispersion, and then extraction by methanol, and drying to finally produce epoxy resin-coated graphite fluoride powder particles in form of coarse lamp. These lumps were then impact-pulverized into a 500-mesh screen passable size. The epoxy resin coating was 6% in amount.

The powder product was sprayed over a steel plate (SPCE-1) by the electrostatic spray machine of over 15 seconds under the voltage of −90 KV, to achieve a coat about 600μ thick. Then, the coating film was subjected to heating at 250° C for 10 seconds in a nitrogen streaming oven, to finally make a fused form.

This fused film was subjected to the abrasion test by the Taber abraser, which resulted in the loss in quantity of about 25 mg. For comparison, the same but untreated steel plate was similary tested, resulting in the loss in quantity of 80 mg. Thus, the film formed according to the process of this invention was proved to have an excellent anti-abrasive property.

Incidentally, the testing conditions with the Taber abraser were 1,000-g load, H-18 abrasive, and 300 revolutions.

EXAMPLE 6

1 kg of frit powder (F-718 of Kanto Horo-Yuyaku Company) passing through a 200-mesh screen was immersed in an 0.12% solution of stearic acid in ethanol, resulting to coat the powder particles with stearic acid about 0.08% in amount. The resulting powder was put into a solution of 100-g methylmethacrylate resin in 500-cc methylene chloride, followed by agitation to make a dispersion. To this dispersion was slowly added a solution of 100-g polyvinyl alcohol in 3-liter water to emulsify, followed by agitation till the methylene chloride was evaporated. The resulting product was decantated, washed with water, and dried at 60° C. The methylmethacrylate resin coating retained on the frit particles was about 5% in amount.

The powder product was sprayed over a sand blast-treated and thinly nickel-plated steel plate (SPCE-1) by an electrostatic spray machine of Sames over 15 seconds under the voltage of −75 KV, to achieve a coat about 1,000μ thick. Then, the coating film was subjected to sintering in an electric over an 800° C over 3 minutes, to finally produce a uniform sintered layer of frit about 500μ thick.

The sintered layer was applied to the adhesion test in accordance with Japanese Industrial Standard (JIS), R430, to find out that the layer had no peeling. Even after a period of 6 months, there was no copperhead phenomenon on the layer.

EXAMPLE 7

Soda-lime glass powder containing 70% $SiO_2$, 12% $Na_2O$, 10% CaO, 2% $Al_2O_3$, and 1.5% MgO, having a size passable through a 250-mesh screen was immersed in stearic acid-ethanol solution, resulting to coat the powder particles with stearic acid about 0.08% in amount.

The resulting powder particles were made invertingly fluid, and over the fluid particles were sprayed a 10% solution of epoxy resin (1007 of Shell Chemicals) in methylethyl ketone, to produce epoxy resin-coated glass particles, the epoxy resin coating being about 5% in amount. These powder particles were then placed in a fluidized bed tank, to form a fluidized bed into which a steel plate (200 × 200 × 2 mm, SPCE-1) preheated at about 330° C was immersed for 10 seconds, resulting in the formation of film about 2 mm thick. Then, the thus-coated steel plate was heated at the rate of 10° C per minute up to 550° C in a nitrogen streaming oven and allowed to stand there for 20 minutes. As a result, the glass particle surfaces became smooth and the epoxy resin ingredient was completely decomposed and removed. Then, the oven was heated up to 820° C and the glass material was allowed to start theremoplastic fluidization at that temperature for about 20 minutes. The temperature of the oven was then further elevated to 1,240° C, at which temperature sintering was carried out over a period of 30 minutes. Upon completion of the sintering, the temperature was lowered to 400° C at the rate of 5° C per minute, followed by allowing to stand till it became as low as room temperature. The resulting layer was uniformly 1.3 mm thick.

According to observation of the sintered layer, it having no pinholes nor copper-heads was tightly bonded to the steel plate in fused condition; there were no formation of fayalite ($2FeO.STO_2$), magnetite ($Fe_3O_4$), or hematite ($Fe_2O_3$) at the interface of the overlayer and the steel plate surface.

EXAMPLE 8

Silicate glass powder composed of particles sized passable through a 400 mesh screen was immersed in a solution of a silane (KBM 503 of Shinetsu Chemical Company) in methanol, and the resulting silane-coated particles were dried at about 150° C. The dried particles were put into a solution of epoxy resin (1007 of Shell Chemicals) in methylethyl ketone, followed by agitation to make a dispersion. From this dispersion, the solvent (methylethyl ketone) was extracted and removed by use of an aqueous solution of methanol, followed by water-washing and drying at 60° C, to obtain epoxy resincoated silicate glass particles.

These particles were then mechanically pulverized, and the pulverized product was sprayed over an asbestos sheet (No. 2 according to JIS) by the Sames electrostatic spray machine for 10 seconds under the voltage of −90 KV, to achieve a coat 800μ thick. The asbestos and epoxy resin coated glass particle composite was heated at 280° C for 20 minutes in a nitrogen streaming oven, followed by cooling to achieve initimate bonding. The layer thus obtained was found to have a very smooth surface and a uniform thickness.

EXAMPLE 9

Sphere-like copper powder particles having a size of 10 – 30μ were dispersed in an 8% solution of epoxy resin (1007 of Shell Chemicals) in methylethyl ketone, followed by extraction of the solvent by ethanol and drying. The dried product was pulverized to obtain epoxy resin-coated copper particles sized passable through a mesh screen of 300 – 800, the epoxy resin coating being about 6% in amount with an almost uniform thickness.

The thus-obtained powder 2 liter in amount was applied to a fluidized bed tank available on the market (sized 20 cm in diameter and 80 cm high) to form a fluidized bed therein by use of air blown at the pressure 5 kg/cm². In this fluidized bed of the powder particles a steel plate (100 × 150 mm, SPEC-1) preheated at 300° C was placed for 10 seconds, resulting to achieve a coating film 800μ thick. This film was found to have good surfacing as well as bonding properties.

The thus-treated steel plate was then subjected to hot press at 200° C under the pressure of 200 kg/cm² for about 10 seconds to increase the coating density, followed by sintering at 1,000° over 30 minutes in a nitrogen streaming oven, to achieve a layer 300μ thick. This sintered layer was found to have good bond with copper-iron alloy or copper material.

For purposes of comparison, a similar procedure was repeated on epoxy resin-coated copper particles in which the epoxy resin coating was 0.8% and 18% in amount, resulting in the production of a coating film, approximately 100μ in thickness on the average, worn off in places in the case of the former case (0.8%), or approximately 1 mm thick having many areas raised above or depressed below its surface in the case of the latter case (18%). Further, the sintered layer obtained from each of both cases were found to have many holes several tens of microns in diameter.

The optimum temperature to which the steel plate should be preheated according to this invention was between 280° and 350° C.

EXAMPLE 10

Sphere-like copper powder particles having a size of 10 – 30μ were dispersed in a 10% solution of polymethylmethacrylate resin (MH-101-2 of Fujikura Chemical Company) in toluene, and the resulting dispersion was treated by the gaseous phase suspension coating method to produce polymethylmethacrylate resin-coated copper particles. These particles sized passable through a mesh screen of 325 – 800, and the polymethylmethacrylate resin coating being about 7% in amount, were applied to the same fluidization apparatus as in Example 9 to form a fluidized bed by use of air blown at the pressure of 7 kg/cm². Subsequently, the steel plate as used in Example 9 which had been preheated at 220° C was immersed in the above formed fluidized bed for 10 seconds, resulting to achieve a coating film 800μ thick. This film was found to have good surfacing as well as bounding properties.

The thus-treated steel plate was then subjected to hot press at 150° under 200 kg/cm² for about 10 seconds to increase the coating density, followed by sintering at 950° C over 30 minutes in a nitrogen streaning oven. According to observation, there were witnessed the formation of a widely spread strong copper-iron alloy and a good volume flow of copper material, and some twins formed by thermal deformation.

EXAMPLE 11

8 kg of tungsten disulfide powder (product of Japan Lubricant Co.) composed of particles passable through an 800-mesh screen was added to a solution of 1.2 kg epoxy resin (1007 of Shell Chemicals) in 4-liter methylethyl ketone. The mixture was well stirred, followed by repeated decantation and drying at 60° C, resulting in the production of epoxy resin-coated tungsten disulfide powder particles. Then, according to the procedure of Example 9, a fluidized bed of the coated product was formed with air applied at the pressure of 6 kg/cm². In this fluidized bed a bronze plate preheated at 300° C was placed for 10 seconds, resulting to obtain a coating film about 600μ thick. The coated bronze plate was then cut to obtain a piece sized 100 × 100 cm, and this piece was subjected to the abrasion test in comparison to a similar sized bronze plate which had no coating treatment. These test results indicated the losses in quantity of 35 mg on the treated bronze plate according to this invention and 60 mg on the comparative untreated bronze plate. Incidentally, the testing conditions were 1,000-gram load, H-18 abrasive and 300 revolutions.

EXAMPLE 12

2 kg of graphite fluoride powder (product of Japan Carbon Company) composed of particles passable through an 800-mesh screen was added to a solution of 0.5 kg epoxy resin (1007 of Shell Chemicals) in 2-liter methyethyl ketone. The mixture was well stirred, followed by repeated decantation and drying at 60° C, resulting in the production of epoxy resin-coated graphite fluoride powder particles, the epoxy resin coating being 7% in amount. Then, according to the procedure of Example 9, a fluidized bed of the coated product was formed with air applied at the pressure of 5 kg/cm². In this fluidized bed a steel plate (200 × 200 × 1 mm, SPCE-1) was placed for 10 seconds, resulting to obtain a coating film 500μ thick.

Then, the same abrasion tests as in Example 11 were conducted on the above-coated steel plate and an uncoated steel plate (SPCE-1) for comparison. The test results indicated the losses in quantity of 20 mg and 80 mg, respectively.

EXAMPLE 13

5 kg of copper oxide powder having particles passable through a 325-mesh screen was immersed in an 0.15% solution of stearic acid in ethanol for 10 seconds, followed by drying to produce a stearic acid coating 0.05% in amount. The thus surface-treated copper oxide particles were added to a solution of 500-g ethylcellulose (N-type of Hercules Inc.) in 5-liter methylethyl ketone kept at 30° C with agitation. The mixture solution was allowed to stand at room temperature and then, after its supernatant fluid was removed, subjected to decantation repeated 5 times, followed by being allowed to stand at 60° C for 1 hour. The resulting product was pulverized by a hammer-type crusher (Example Mill KII-1of Fuji Powder Co.) into a particle size passable through a 150-mesh screen or so. The ethylcellulose coating was found about 5% in amount, nearly uniformly covering each particle.

The powder product was sprayed over a fat-and rust-removal-treated low carbon steel (200 × 200 × 1 mm. SPCE-1) by an electrostatic spray machine (product of Sames) over a period of 15 seconds under the voltage of −85 KV. The resulting coating film, about 600μ thick, was subjected to hot press under 150 kg/cm² at 130° for 15 seconds, to increase its density, and thereupon to sintering in a nitrogen streaming oven at 1,000±10° C for 100 minutes, to finally produce a metallic layer composed of sintered coppen oxide, having a thickness of about 300μ.

According to observation, the copper oxide was almost completely reduced to gases produced by abrupt thermal decomposition of the ethylcellulose; there was witnessed a copper-iron alloy layer 0.2μ thick on the interface between the steel plate surface and the sintered layer. When the sintered layer surface was treated with skin pass, it became glossy and uniform.

EXAMPLE 14

5 kg of sphere-like copper powder particles passable through a 325-mesh screen were immersed in an 0.15% solution of stearic acid in ethanol for 10 seconds, followed by drying at room temperature for 2 hours, to produce a stearic acid coating 0.08% in amount. The thus-treated copper power particles were added to a solution of 500-gram polyvinyl chloride resin (Vinylchlon 4000LL of Mitsui-Toatsu Chemical Co.) in 5-tetrahydrofuran, followed by sufficient agitation and then addition of water, to obtain a whitened liquid containing the vinyl chloride resin and the sphere-like copper particles in the form of mixture. The whitened liquid was well washed with water and then dried at 60° C for 1 hour, and the resulting product was pulverized by a hammer-type crusher (Example Mill KII-1 of Fuji Powder Co.) into a particle size passable through a 100-mesh screen or so. The vinyl chloride resin coating was about 7% in amount, nearly uniformly covering each particle.

The powder product was applied to a fluidized liquid bed coating processes to achieve its coating on a low carbon steel plate, (SPCE-1). Details of the coating conditions are as follows.

The steel plate to which the vinyl chloride resin-coated copper powder should be applied was treated by the blasting apparatus (made by Fuji Works, the abrasive material being No. 100 alundum, and air pressure being 4 kg/cm²), and then heated up to 300° C in an electric oven. Then thus surface-cleaned and heated steel plate was placed over a period of 15 seconds in the fluidized bed coating tank in which the vinyl chloride resin-coated cooper particles had been made in a fluidized bed by use of air blown under the pressure of 5 kg/cm².

The thus-treated steel plate, having taken out of the fluidized bed coating tank, was again heated to 250° C in the electric oven for 1 minute, and thereupon slowly cooled, resulting in a very good bonding of the fused vinyl chloride resin and cooper composite to the steel plate base, the surface of which had previously been treated with the blasting process.

The coated steel plates appear beautiful, and can be suitable for interior appliances. Besides, it is possible to obtain a sintered copper film of 500 - 800 μ thick by subjecting the coated steel plate to heating in a non-oxidizing atmosphere so that the vinyl chloride resin may be decomposed and evaporated and, at the same time, the cooper ingredient may be sintered.

EXAMPLE 15

100 g of the methyl methacrylate resin-coated frit powder particles obtained in Example 6 were applied to the electrophoretic deposition in order to coat a low carbon steel plate (50 × 50 mm, SPCE-1), the surfaces of which had been cleaned by sand blasting and thinly plated with nickel, in a 2-liter aqueous bath containing aluminum chloride as the electrolyte and nonionic surfactant (NS-208 of Japan Oils & Fats Co.) each in an amount of 0.5 g per liter of liquid, and provided with a piece of carbon sheet (100 × 100 mm), the steel plate being the anode and the carbon sheet being the cathode, through which was sent the direct current, the voltage being 150 V and the initial amperage being 0.16 A. The electrodeposition was completed in 5 minutes. Thereupon, the steel plate was taken out of the bath and subjected to drainage and drying at 50° C over a period of 30 minutes. The deposited layer was 12.5 g/dm² in amount.

The coated steel plate thus obtained was sintered in a heating over kept at 780±20° C for 5 minutes, to achieve a white frit layer having a beautiful surface, quite free of resinous residues and copper-head occurrence. The thickness of the sintered frit layer was about 250μ .

EXAMPLE 16

1 kg of frit powder (product of Kanto HoroYuyaku Company, having a melting point of 650° C) composed of particles passable through a 300-mesh screen was immersed in an 0.15% solution of stearic acid in ethanol, resulting to coal the particles with stearic acid 0.07% in amount. The resultant powder was put into a solution of 50-g epoxy resin (1007 of Shell Chemicals) and 5-g methylethylketone peroxide in 7-liter methylene chloride, followed by sufficient mixing. This mixture solution was then heated to about 60° C till the solvent was vaporized. The resulting solid product was reduced by a ball mill to particles passable through a 200-mesh screen, to obtain epoxy resin-coated frit powder particles, the epoxy resin coating being about 4% in amount.

The powder product was applied to the fluidized bed coating method to coat a low carbon steel plate which had previously been subjected to blasting and thinly plated with nickel and heated to 150° C. The coat was about 250 μ thick. The coated steel plate was heated at 150° C for 5 minutes and then subjected to sintering at 800° C for 3 minutes, to finally obtain a uniform, smooth sintered layer of frit, free of resinous residues.

For comparison purposes, a similar test was carried out without the use of methylethylketone peroxide and it was found that the resulting layer had a less smooth surface.

EXAMPLE 17

1 kg of frit powder (product of Kanto Horo-Yuyaku Company, having a melting point of 550° C) composed of particles passable through a 300-mesh screen was immersed in an 0.15% solution of stearic acid in ethanol, resulting to coat the particle with stearic acid about 0.05% in amount. The resultant powder was put into a solution of 30-g polyester resin (Torex of Mitsui-Toatsu Chemicals) and 2-g di-tert-buylperoxide in 6.5-liter methylene chloride, followed by sufficient mixing. This mixture solution was then heated to about 60° C till the solvent was volatilized. The resulting solid product was reduced by a ball mill to particles passable through a 200-mesh screen, to obtain polyester resin-coated frit particles, the polyester resin coating being about 2.5% in amount.

The powder product was sprayed over an asbestos sheet by an electrostatic coating machine of Sames to achieve a coating film about 280 μ thick. The electrostatic spray was carried out with the voltage of −75 KV over a period of 15 seconds. The coated asbestos sheet was heated at 120° C for 5 minutes and then subjected to sintering at 700° C for 3 minutes, to finally obtain a smooth-surfaced layer of sintered frit.

For comparison proposes, a similar test was carried out with no use of the di-tert-butylperoxide and it was found that the resulting layer had a less smooth surface.

What is claimed is:

1. A process of forming a uniform film at least 200 μ thick on a substrate which comprises surface-treating an inorganic substance having a particle size range from 0.1 to 500 microns with a surface-treating agent to render its surface compatible with plastics, said surface-treating agent being selected from the group consisting of stearic acid, palmitic acid, gamma-methacryloxypropyltrimethoxy silane, gammaglycidoxypropyltrimethoxy saline, and beta-ethyltrimethoxy silane, coating each surface-treated particles with plastic in an amount equal to 1 to 15% by weight of the particle, drying the coated particles, applying said dried coated particles to the substrate, and heating and fixing the layer thus provided on the substrate surface at a temperature between the melting point and the volatilizing point of the plastic.

2. The process according to claim 1 wherein the inorganic powdered substance is selected from the group consisting of metals, alloys, sulfides of metals, carbon fluoride, ceramics, and glass.

3. The process according to claim 2 wherein the metals are copper, aluminum, titanium, and nickel; the alloys are brass and bronze; the sulfides of metals are disulfide molybdenum and disulfide tungsten; glass is silicate glass, soda-lime glass, potassium-lime glass, lead glass, and borate-silicate glass.

4. The process according to claim 1 wherein the application of the plastic-coated inorganic particles to the substrate is conducted by electrostatic powder spraying.

5. The process according to claim 1 wherein the application of the dried plastic-coated inorganic particles to the substrate is conducted by electrophoretic deposition.

6. The process according to claim 1 wherein the application of the plastic-coated inorganic particles to the substrate is conducted by electrostatic fluidization.

7. The process according to claim 1 wherein the application of the plastic-coated inorganic particles to the substrate is conducted by fluidized bed coating.

8. The process according to claim 1 wherein the plastic is selected from the group consisting of polyethylene resin, polystyrene resin, epoxy resin, polymethylmethacrylate resin, polyvinyl chloride resin, polyvinyl alcohol resin, polyester resin and ethylcellulose.

9. The process according to claim 1 wherein an organic peroxide is added to the plastic.

10. The process according to claim 1 wherein the layer provided on the substrate surface is heated to such extent that the plastic ingredient is fused.

11. The process according to claim 1 wherein the layer provided on the substrate surface is heated to such extent that the plastic ingredient is volatilized.

* * * * *

UNITED STATES PATENT OFFICE

CERTIFICATE OF CORRECTION

Patent No. 4039697 Dated August 2, 1977

Inventor(s) Kazuo Isawa et al

It is certified that error appears in the above-identified patent and that said Letters Patent are hereby corrected as shown below:

In the heading of the Patent [30] should read as follows:

--[30] Foreign Application Priority Data

Aug. 27, 1973 Japan.....48-95924
Aug. 27, 1973 Japan.....48-95925
Aug. 27, 1973 Japan.....48-95926--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*